United States Patent [19]

Skinner

[11] 3,991,976

[45] Nov. 16, 1976

[54] IMPLEMENT FOR DRIVING AND REMOVING FENCE POSTS

[76] Inventor: Warren Skinner, 520 Delphi, Sheridan, Wyo. 82801

[22] Filed: Sept. 2, 1975

[21] Appl. No.: 609,690

[52] U.S. Cl. ..... 254/30; 254/131; 254/132

[51] Int. Cl.[2] ..... E21B 19/00

[58] Field of Search ..... 254/30, 131, 132

[56] References Cited

UNITED STATES PATENTS

| | | | |
|---|---|---|---|
| 2,311,063 | 2/1943 | Martin | 254/132 |
| 2,532,533 | 12/1950 | Baldwin et al. | 254/131 |
| 2,634,157 | 4/1953 | Haddock | 254/30 |
| 2,777,726 | 1/1957 | Lundgren et al. | 254/30 |
| 2,826,392 | 3/1958 | Kohorst | 254/30 |
| 3,779,516 | 12/1973 | King | 254/30 |
| 3,815,875 | 6/1974 | Koebel | 254/132 |

*Primary Examiner*—Al Lawrence Smith
*Assistant Examiner*—Robert C. Watson
*Attorney, Agent, or Firm*—Lowe, Kokjer, Kircher, Wharton & Bowman

[57] ABSTRACT

A post removing device attaches to the handle of a post driving implement. The device includes a flat bar which is pivotally connected to the implement handle. A flange plate is bent at an angle on the outer end of the bar to engage one edge of the fence post. Vertically spaced arms mounted on the bar have edges that engage the opposite side of the fence post. The post is tightly gripped between the flange plate and arms with the implement handles resting on the ground. The device raises the post from the ground as the implement is tilted on the base of its handles.

4 Claims, 2 Drawing Figures

IMPLEMENT FOR DRIVING AND REMOVING FENCE POSTS

BACKGROUND AND SUMMARY OF THE INVENTION

This invention relates generally to the handling of fence posts and deals more particularly with a post driving implement to which a post removing device is attached in order to permit the implement to be used both to drive and remove fence posts.

The various post pulling devices that have been developed in the past typically require long levers, complicated stands or base structures, and a large number of parts. Aside from the resulting high cost and undue complexity, these devices are cumbersome and time consuming to operate and difficult to assemble. A further disadvantage of existing post pulling devices is that they are so large and bulky as to be awkward to handle and transport in the field. Consequently, the removal of fence posts and the like from the ground has required considerable time, difficulty and expense in the past. In addition, it is presently necessary to use one implement to drive the posts and another separate implement to remove them, and this further adds to the difficulties involved in the construction and repair of fences and similar structures.

It is an important object of the present invention to provide an improved post removing device which is combined with a post driver in order to eliminate the need for separate implements to drive and remove posts. This accomplishment results in a highly versatile implement which utilizes the post driver for the necessary force and leverage in removing posts and thereby eliminates the need for additional levers, stand structures, and other complicated components required in the prior art devices. Further in connection with this object, it is another object of the invention to provide a post removing device which is readily adapted to be installed on existing post driving implements and which does not interfere with the implement when same is used to set posts in the ground.

Yet another object of the invention is to provide a post removing device of the character described which may be quickly and easily applied to the post and which will not slip along the post during the raising of same.

An additional object of the invention is to provide a post removing device of the character described which is ruggedly constructed, economically produced, light in weight, and easily used by a single worker.

Other and further objects of the invention, together with the features of novelty appurtenant thereto, will appear in the course of the following description.

DETAILED DESCRIPTION

Figure 1:
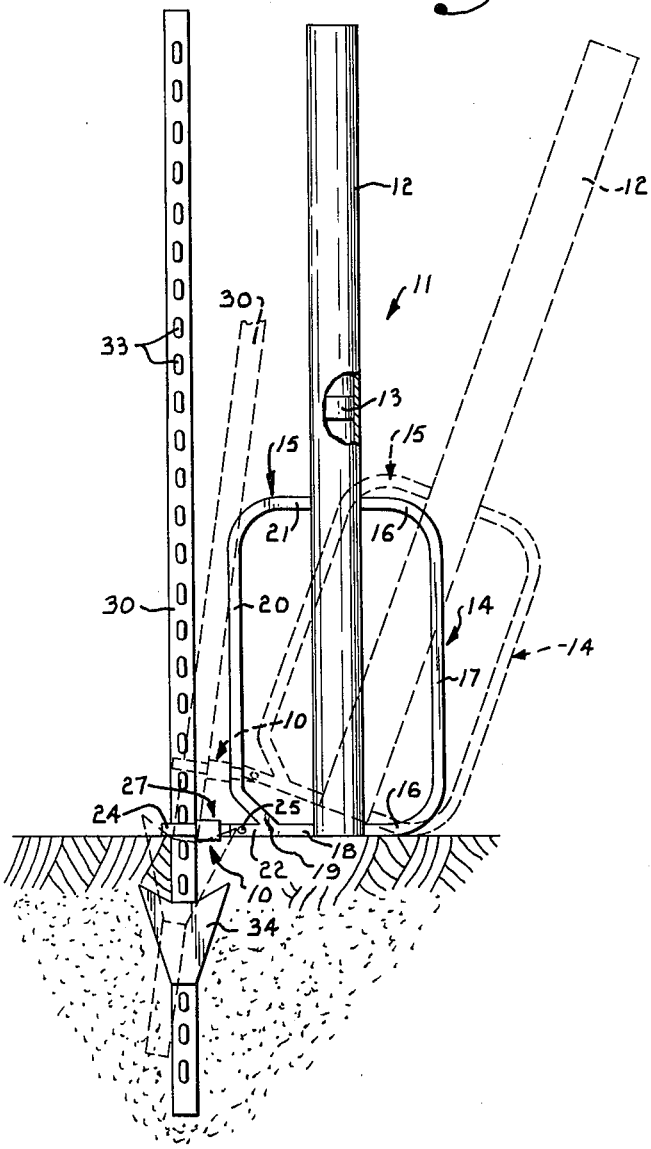
Figure 2:
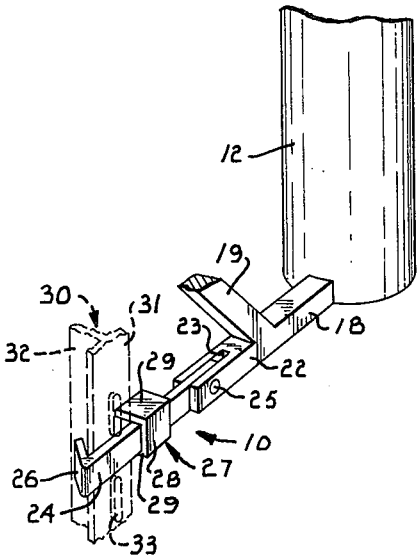

In the accompanying drawings, which form a part of the specification and are to be read in conjunction therewith, and in which like reference numerals indicate like parts in the various views:

FIG. 1 is an elevational view showing a post driving and removing implement constructed according to the invention and positioned to raise a fence post from the ground, the broken lines illustrating the tilting of the implement to partially remove the fence post from the ground; and FIG. 2 is a fragmentary perspective view on an enlarged scale illustrating the post engaging device shown in FIG. 1 in position on the fence post, the latter being shown in broken lines.

Referring now to the drawings in detail, numeral 10 generally designates a post pulling device constructed according to the invention. Numeral 11 designates a conventional post driver to which device 10 is attached. The post driver 11 includes an elongate cylindrical member 12 which is hollow in order to be fit over a post. A post driving head 13 in the form of a thick plug or partition, is rigidly mounted internally of member 12 at an intermediate location with respect to the length thereof to engage the top of a post and drive it into the ground.

Member 12 has a pair of handles 14 and 15 at the end that is fit over the post. Handle 14 includes horizontal legs 16 which project outwardly from member 12 at spaced locations and which are curved at their outer ends where they connect to a vertical bar 17 that extends between the legs. The other handle 15 projects to the side of member 12 in an opposite direction from handle 14. Handle 15 includes a short, straight leg portion 18 that projects horizontally from the end of member 12 at a right angle. An inclined leg portion 19 (which is part of the handle 15) extends from the end of leg portion 18 at an angle and connects at its outer end to one end of vertical bar 20. A horizontal leg 21 extends outwardly from member 12 and is curved at its outer end where it connects to the other end of bar 20. Handles 14 and 15 are manually held when the implement is used to drive posts into the ground.

A short integral stub 22 extends straight outwardly from the end of leg portion 18 to form a horizontal extension thereof. Stub 22 is substantially square in cross-section, as are leg portions 18 and 19. The outer end of stub 22 is provided with a recess 23 (FIG. 2) in order to receive and pivotally mount the post pulling device 10.

The body portion of device 10 comprises a straight flat bar 24 of rectangular cross-section. Bar 24 is oriented in a vertical plane such that it presents a relatively large surface area on its side which contacts the fence post when the device is positioned on the post, as shown in FIG. 2. One end of bar 24 is pivotally connected to stub 22 within recess 23 by a horizontal pivot pin 25. Bar 24 projects outwardly from stub 22, and an integral flange plate 26 is turned at an acute angle from the outer end of the bar. Flange plate 26 extends generally to one side of bar 24 and is preferably bent from the bar such that it forms an angle therewith of between 30° and 50°. Flange plate 26 is oriented to lie in a vertical plane, and the angled crease area presented between it and bar 24 therefore extends a considerable vertical distance in order to receive one edge of a fence post.

A C-shaped member 27 is secured to bar 24 at an intermediate location thereon. With reference to FIG. 2, member 27 includes a flat central plate 28 which is welded or otherwise rigidly connected flatly against the surface of bar 24. Flat, plate-like arms 29 extend parallel to one another from the upper and lower edges of plate 28. Arms 29 are vertically spaced from one another and lie in horizontal planes perpendicular to bar 24. The arms project to the same side of bar 24 as flange plate 26, and straight side edges of the arms confront the side of the fence post opposite from that engaged by flange plate 26 when the device is positioned on the fence post.

The post pulling device 10 is used to remove a fence post 30 from the ground. The fence post is constructed in the usual T-shaped cross-section that includes a flange 31 from which a perpendicular leg 32 extends. Flange 31 is typically provided with a plurality of projections 33, while an enlarged barb 34 is secured near the lower end of the post. Barb 34 is generally wedge shaped in order to firmly retain the post in the ground. The width of flange 31 is substantially equal to the distance between flange plate 26 and arms 29 so that the flange plate and arms are able to tightly grip flange 31 therebetween.

To remove fence post 30 from the ground, the post driver 11 is held with handles 14 and 15 adjacent the ground. Device 10 thus rests on the ground, and the device is positioned on the post as shown in FIG. 2. With bar 24 angled relative to flange 31 of the post, flange plate 26 is fit over one edge of flange 31 until the angled crease area where plate 26 and bar 24 meet is engaged against the edge of flange 31. The device is then moved toward the fence post until the inside face of bar 24 engages the surface of flange 31 and arms 29 confront the other edge of flange 31.

The upward end of post driver 11 is then pulled away from fence post 30 and downwardly in order to tilt or pivot the post driver about the curved area where legs 16 and bar 17 connect. As the post driver is tilted from the solid line position of FIG. 1 to the broken line position thereof, device 10 will be raised above the ground and will move slightly to the right as viewed in FIG. 1. The device will also pivot somewhat about coupling 25. Since flange 31 is tightly engaged on three sides by device 10, the fence post will be raised by the device and tilted somewhat to the right to the position shown in broken lines in FIG. 1. Additional tilting of the post driver will result in the fence post being removed completely from the ground.

It is apparent that the pivoting of device 10 about coupling 25 during removal of the post results in the post tilting or becoming angled to a lesser extent than member 12, as can be seen in the broken lines of FIG. 1. Therefore, as the fence post is being raised, the force exerted on the post by flange plate 26 always includes a substantial transverse component which acts in a direction perpendicular to the axis of the post 30 (along with the predominant lifting force). The friction resulting from this transverse force component assists in keeping device 10 from slipping along the fence post. The friction between device 10 and post 30 is further increased because of the large surface areas of the device that are in contact with the post. The majority of the force on post 30 is exerted against the edge thereof that is located in the angled crease area between plate 26 and bar 24. The flange 31 is tightly retained in this angled crease area and is prevented from moving away from bar 24 or slipping along the bar. In addition, the edges of the two arms 29 bear tightly against the post at vertically spaced locations to further reduce the possibility of slippage.

An improved post removing device is thus provided which greatly increases the versatility of the post driving implement without requiring complicated or heavy additions to the implement. Member 12 is sufficiently long to provide the required leverage for removing the post with only a small amount of manual force applied. It is further pointed out that the curved handle 14 allows the implement to be smoothly and easily pivoted in order to remove the fence post.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. An implement for driving posts into and pulling them from the ground comprising, in combination, an elongate post driving member, handle means secured to said driving member adjacent one end thereof and by which the member can be reciprocated for driving a post, said handle means including a surface spaced laterally with respect to the axis of said member and operable, when the member is removed from a post and inverted, to engage the surface of the ground adjacent but to one side of said member thereby to provide a fulcrum about which said member can be tilted to a position inclined from the vertical, and post gripping means connected to and extending laterally with respect to said member at said one end of said member in a direction opposite to said fulcrum surface, said gripping means engageable with the post and operable to apply a lifting force on same in response to the tilting of said member about said fulcrum.

2. An implement as in claim 1, said handle means comprising a generally U-shaped element having the ends thereof secured to said member with one end of said element adjacent said one end of said member.

3. An implement as in claim 1, said handle means including a pair of U-shaped elements located at opposite sides of said member with the ends secured to said member, one of said U-shaped elements providing said fulcrum surface, said post gripping means connected with and extending from the other of said U-shaped elements.

4. An implement as in claim 1, said post gripping means including a bar mounted for pivotal movement with respect to said member, a post gripping element extending laterally from said bar at an acute angle with respect to the bar thus to provide a V-shaped crease for receiving an edge of a post, and a retainer arm also extending laterally from said bar and spaced from said post gripping elements so as to confront an opposite edge of the post.

* * * * *